United States Patent [19]

Perchak

[11] Patent Number: 4,784,268

[45] Date of Patent: Nov. 15, 1988

[54] STAND-UP OR HANGING DISPLAY BLISTER AND PACKAGE

[75] Inventor: William C. Perchak, Chicago, Ill.

[73] Assignee: Plastofilm Industries, Inc., Wheaton, Ill.

[21] Appl. No.: 75,569

[22] Filed: Jul. 20, 1987

[51] Int. Cl.[4] ..... B65D 73/00

[52] U.S. Cl. ..... 206/461; 206/470; 206/471

[58] Field of Search ..... 206/461, 467, 468, 470, 206/471, 807, 45.14, 45.34; 220/337, 339; 229/2.5 R

[56] References Cited

U.S. PATENT DOCUMENTS

| | | | |
|---|---|---|---|
| 3,581,885 | 6/1971 | Wald | 206/470 |
| 3,638,849 | 2/1972 | Goings | 229/2.5 R |
| 3,726,395 | 4/1973 | Duhy | 229/2.5 R |
| 4,005,776 | 2/1977 | Seeley | 206/470 |
| 4,058,220 | 11/1977 | Torongo | 206/461 |
| 4,236,637 | 12/1980 | Castner, Sr. et al. | 206/470 |
| 4,415,084 | 11/1983 | Hauser et al. | 206/461 |
| 4,568,017 | 2/1986 | Grunert | 229/2.5 R |
| 4,702,368 | 10/1987 | Jones | 206/461 |
| 4,702,374 | 10/1987 | Kelner | 206/471 |

FOREIGN PATENT DOCUMENTS

| | | | |
|---|---|---|---|
| 2053836 | 2/1981 | United Kingdom | 206/461 |

*Primary Examiner*—David T. Fidei
*Attorney, Agent, or Firm*—Lee & Smith

[57] ABSTRACT

The bubble for a normally hanging bubble package is thermoformed with an integral base connected with the bottom of the bubble structure by a living hinge at which the base may be pivoted to engage the bottom of the bubble body structure and provide a support for the package in stand-up rather than hanging mode. Structure is provided for fastening the base to the bubble body; such structure may be a latching device comprising male and female elements formed integrally with the bubble at the bottom thereof and in the base, respectively, or may be separately applied adhesive or mechanical fastening devices. The bubble body and flange structure only are bonded to the supporting card leaving the base free to pivot at the hinge to engage the bubble body structure in optional stand-up mode of the package.

11 Claims, 2 Drawing Sheets

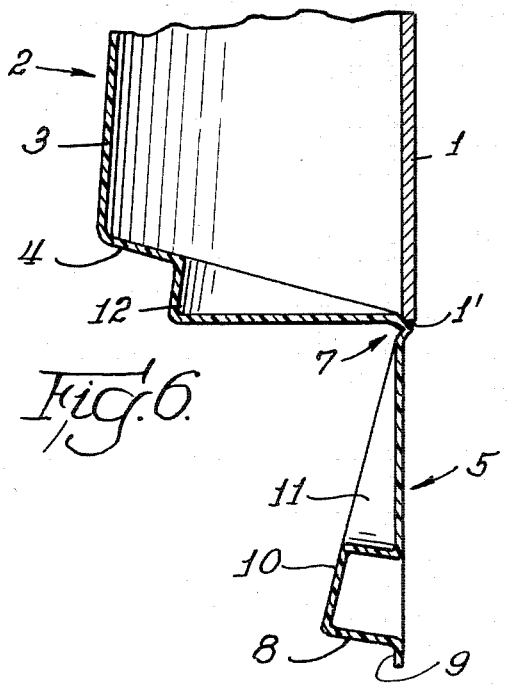
Fig. 6.
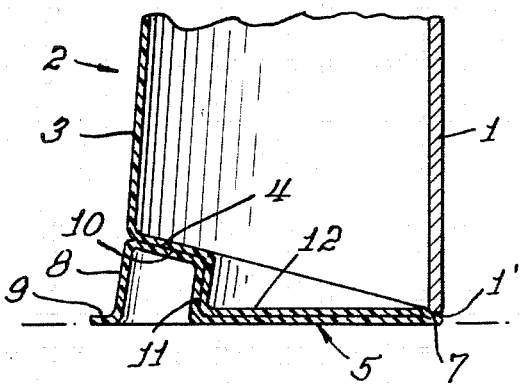
Fig. 7.
Fig. 8.
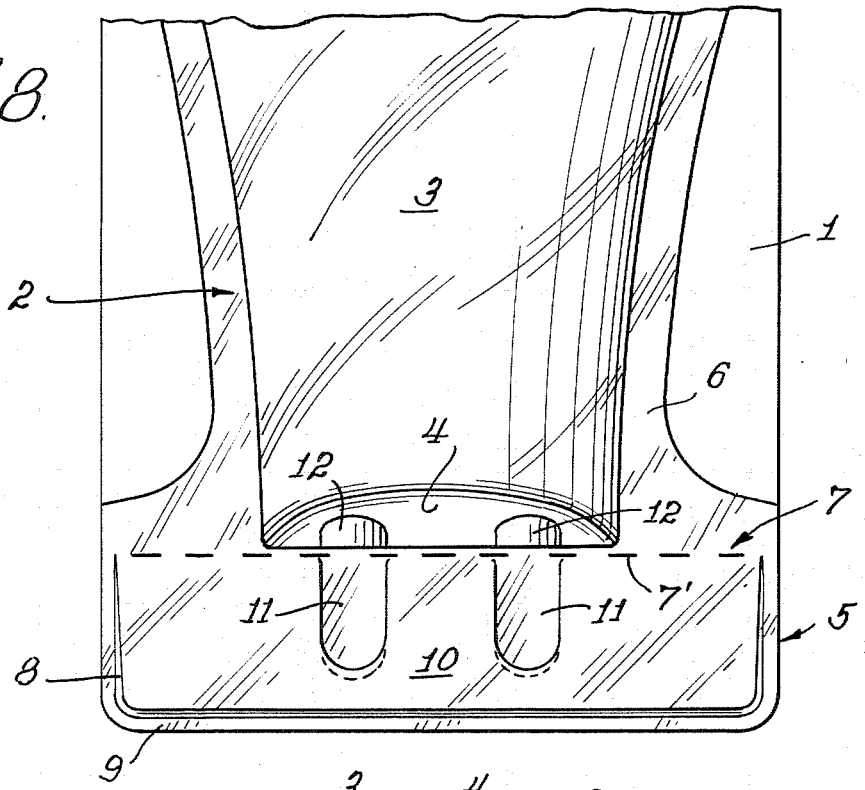
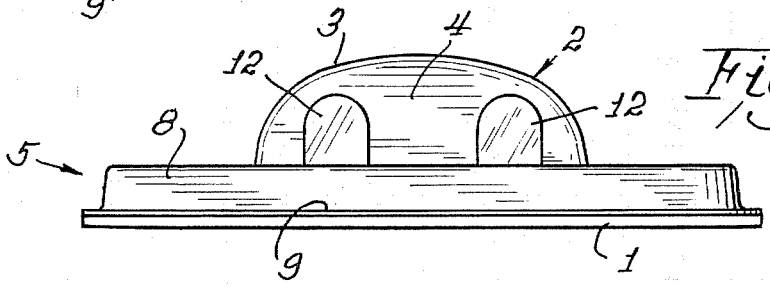
Fig. 9.

STAND-UP OR HANGING DISPLAY BLISTER AND PACKAGE

So-called blister packages have long been used not only for packaging a wide variety of products but also for displaying these products for sale in retail stores. Depending upon the kind of product or products to be contained within each package, the package may be designed to more or less accurately follow the configuration of the article or may be simply rectilinear or otherwise simply shaped to contain a number of small articles such as screws. Such blisters, after filling, are bonded to supporting paper cards having openings at their tops for hanging the packages from the arms of a display stand.

The large numbers of products so packaged and displayed has greatly increased. The blister packages have found wide use in stores because they not only display each item but the display supports also include a reasonable stock of each item so that with the removal of one package the item is still displayed from the remaining stock. As the numbers of blister packages have increased, sometimes on rotatable hanging displays, problems of space have developed for the necessary hanger supports.

These blister packages are not amenable to display other than in hanging position. They can, of course, individually be rested upon a horizontal surface leaning back against a supporting wall of some kind. This is unsatisfactory because few potential customers lifting the package to examine its contents closely will carefully replace the package in its tilted position.

The object of the present invention is to provide a blister package which can be used alternatively as a hanging display or as a stable, free-standing display package. For use as a stand-up display package, it is necessary only to flip a base portion, which is an integral part of the blister, to a latched position providing a planar bottom which is normal to the card backing. The blister, as formed for filling, has a living hinge at the location of the bottom of the blister card when the blister has been filled and the package assembled. It is at this hinge that the base portion of the blister pivots to latched position in the stand-up mode of the package.

BRIEF DESCRIPTION OF THE DRAWINGS

In the accompanying drawings,

FIG. 6 is cross-sectional view on enlarged scale taken at the line 6—6 of FIG. 1;

FIG. 7 is a cross-sectional view similar to that of FIG. 6 and showing the structure in latch, stand-up position;

FIG. 8 is a face view of a package similar to that illustrated in FIG. 1 but showing a relatively wider blister and a generally perforated living hinge and double latching means for holding the base in position to provide a stand-up display, and FIG. 9 is a bottom view of the package of FIG. 8.

DESCRIPTION OF MODES BEST EMBODYING THE INVENTION

Figure 1:
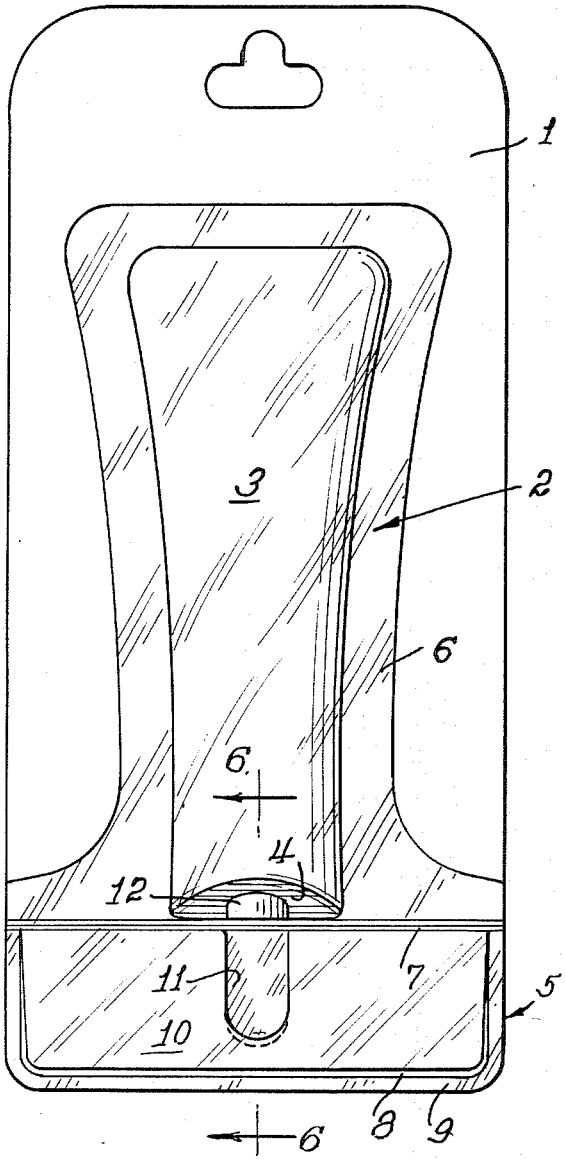
FIG. 1 is a face view of a filled blister package embodying the invention and shown in hanging posture.

In creating a blister that can be used as either a hanging display package or a stable standing package, the inventor has retained all desirable characteristics of known forms of blister such as nesting of empty blister stocks, ease of machine filling, inexpensive bonding to the closing and supporting card, etc. An important central feature of the invention is the provision of an integral base element hinged to the blister body and means for latching the base in position to provide a relatively expansive planar bottom surface when the blister package is to be optionally used as a stand-up, rather than a hanging, display blister package. Other advantageous aspects of the structural design of the blister of the invention will become apparent as the description proceeds.

Examples of blister packages embodying the invention are shown in the attached drawing and described herein. The package comprises the usual card 1 to which is bonded the thermoformed blister 2. In these examples, the blister is elongated vertically and includes a body 3 having a flat, inclined bottom 4. In carrying out the purpose of the invention, a rectangular base 5 is provided for optional use, being connected to the flange 6 and the body of the blister by a living hinge 7. The base 5 includes skirt flanges 8 and lateral peripheral flanges 9 which latter together provide a planar bottom surface for the base which in the standup mode of the package is normal to the vertical plane of the blister card. The sloping top surface 10 of the base 5 provides thereunder space for a recess 11 dimensioned to receive a latching element 12 which is formed in the bottom 4 of the body of the blister. The bottom of the recess 11 is preferably flat and coplanar with the bottom surfaces of flanges 9. The forward portions of both the recess and the latching element are provided with undercuts in known manner to effect a snap retention of the base to the bottom of the body of the blister when interconnected. When so assembled, the blister package stands erect upon its base.

In bonding the filled blister body to its card, it is preferable that the bottom edge 1' of the card does not extend appreciably beyond the living hinge of the blister as this would interfere with the otherwise planar bottom surface of the base 5 and possibly destabilize the vertical posture of the standing package. However, if a rectangular base is used, some extension of the card beyond the living hinge would still provide a stable package since the edge of the card and the distal edge of the base could define a plane substantially normal to the plane of the card.

Preferred features of construction of the living hinge 7 are illustrated in the enlarged detailed views of FIGS. 6 and 7. When formed with the "V" section as shown, bending of the plastic material as the base is pivoted to latched position occurs principally at the vertex of the "V" and the lower leg engages the upper leg and the body of the base to provide a planar under surface at the hinge as illustrated in FIG. 7.

Figure 3:
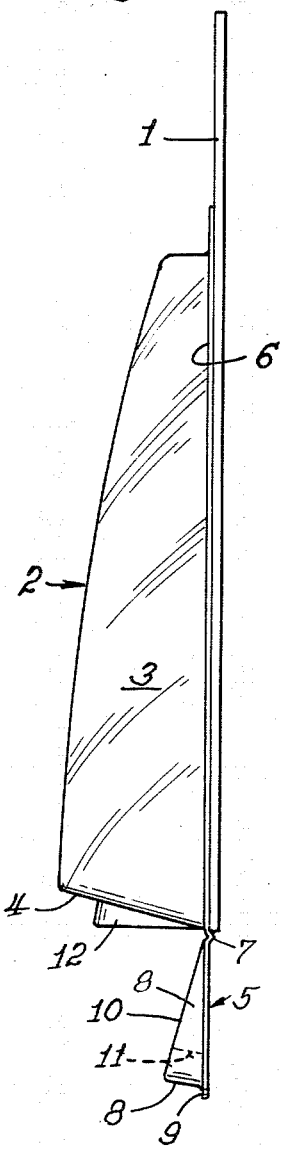
FIG. 3 is a side elevational view of the blister package of FIG. 1.
Figure 4:
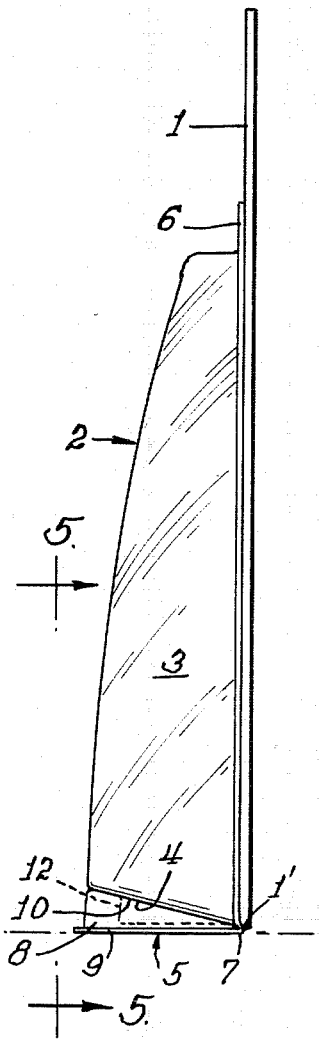
FIG. 4 is a side elevational view of the package illustrated in FIGS. 1-3 but having the base pivoted at the living hinge and latched in position to form a free standing display package.
Figure 2:
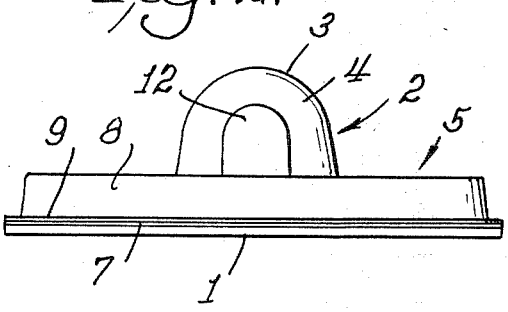
FIG. 2 is a bottom view of the blister package of FIG. 1.
Figure 5:
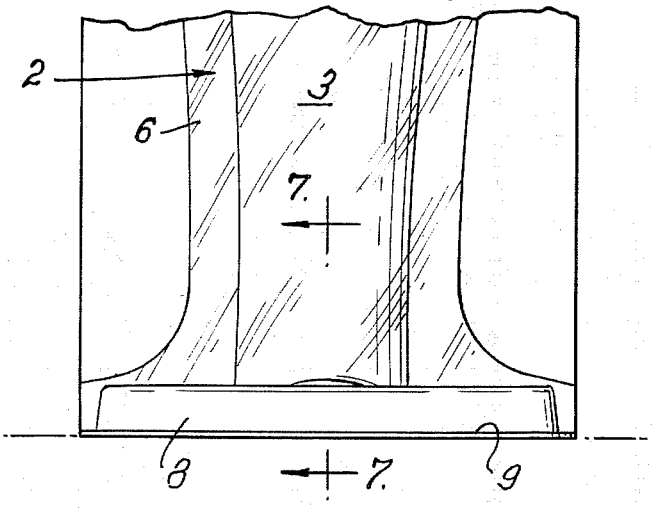
FIG. 5 is a face view on enlarged scale of a portion of FIG. 4 at the line 5—5 thereof.

It is recognized, of course, that the particular design of a blister must be adapted to the intended contents of the package. For example, if the blister is to be relatively wide at its bottom, it may be desirable to provide a pair of latching devices, as shown in FIGS. 8 and 9, to insure a planar and normal bottom surface and thus insure stability of the package in stand-up mode. In these figures of the drawings, reference numerals designating the elements of the structure are the same as those used to designate the corresponding elements of the device shown in FIGS. 1–7. Also, while the rectangular base probably offers the greatest stability of the stand, it may be semi-ellyptical or other form more pleasing in appearance.

The dotted line 7' along the living hinge 7 as illustrated in FIG. 8 indicates a series of cuts along the hinge at the bending line to minimize the secondary bending of the material alongside the line which might render the bottom surface of the base less than truly planar. The weakened hinge, while desirable, is certainly not essential.

It will be appreciated that means for securing the base 5 of the blister to the body thereof in stand-up mode position other than the integral latch structure shown and described by way of example may be employed. The bottom of the blister body, area 4, which is engaged by the top surface 10 of base 5 may be at least partly covered by a patch of double-faced pressure sensitive tape which may serve to secure the base to the bubble body in the standing mode of the package. Or, the respective mating parts of a hook and loop fastener, such as that sold under the trademark "Velcro", may be cemented to the respective base and bubble surfaces which mutually engage when the package is in the standing mode. Other kinds of fastening means may be used as equivalents of the latching arrangement shown and described.

ACHIEVEMENT

The invention herein described creates a blister package which may be used in hanging position or, by a very simple manipulation can be converted to a stable, free standing display. This important feature is made possible without sacrificing desirable features of blister packages and offers an additional merchandising tool for expanded use and utility of blister type display packages.

What is claimed is:

1. A thermoformed bubble for a bubble package usable either in a hanging or a free-standing display package comprising a bubble body, said body having peripheral flanges and a bottom portion, a base optionally usable to support said body in free-standing posture, said base being integral with said body and peripheral flanges and connected therewith by a living hinge crosswise of said bubble at said bottom portion of said body and peripheral flanges thereof, and means for fastening said base to said bottom portion of said body when pivoted about said hinge to a position normal to said peripheral flanges and engaging said bottom portion of said bubble.

2. A thermoformed bubble in accordance with claim 1 wherein said base is generally rectangular in plan, a long side of said base being connected with said living hinge.

3. A blister package comprising a supporting card and a bubble in accordance with claim 1 secured thereto, said card covering and being bonded to said bubble body and said peripheral flanges thereof but extending only to said living hinge whereby said base may be pivoted about said hinge independently of said card to provide a base for said blister in stand-up modes of said package.

4. A thermoformed bubble in accordance with claim 1 wherein said means for fastening said base to said bottom portion of said body comprises latching structure of latching element integral with said bottom portion of said body and mating recess integral with said base of said thermoformed bubble.

5. A blister package comprising a supporting card and a bubble in accordance with claim 4 secured thereto, said card covering and being bonded to said bubble body and said peripheral flanges thereof but extending only to said living hinge whereby said base may be pivoted about said hinge independently of said card to provide a base for said blister in stand-up mode of said package.

6. A thermoformed bubble in accordance with claim 4 wherein said base has a top surface sloping upwardly away from said hinge and skirt flanges depending from the sides thereof other than the side adjacent said hinge, the bottom edges of said skirt flanges having lateral peripheral flanges defining a plane with their under surfaces, said recess of said latching structure being entirely within the space between said top sloping surface of said base and said plane.

7. A thermoformed bubble in accordance with claim 6 wherein said bottom portion of said bubble body is flat and slopes upwardly away from said hinge and said latching element protrudes downwardly therefrom in a position to mate with said recess in said base in said latching structure.

8. A blister package comprising a supporting card and a bubble in accordance with claim 7 secured thereto, said card covering and being bonded to said bubble body and said peripheral flanges thereof but extending only to said living hinge whereby said base may be pivoted about said hinge independently of said card to provide a base for said blister in stand-up mode of said package.

9. A thermoformed bubble in accordance with claim 1 wherein said means for fastening said base to said bottom portion of said body comprises a latching structure in accordance with claim 6 and a second latching structure arranged side-by-side therewith.

10. A thermoformed bubble in accordance with claim 1 wherein said living hinge is weakened by a series of spaced cuts along said hinge at the bending line thereof whereby to minimize secondary bending alongside said bending line.

11. A blister package in accordance with claim 3 wherein said living hinge is weakened by a series of cuts along said hinge at the bending line thereof whereby to minimize secondary bending alongside said bending line.

* * * * *